US011780248B2

(12) United States Patent
Kuo

(10) Patent No.: US 11,780,248 B2
(45) Date of Patent: Oct. 10, 2023

(54) PRINTING SYSTEM WITH UNIVERSAL MEDIA BORDER DETECTION

(71) Applicant: Eastman Kodak Company, Rochester, NY (US)

(72) Inventor: Chung-Hui Kuo, Fairport, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 17/523,003

(22) Filed: Nov. 10, 2021

(65) Prior Publication Data

US 2022/0169049 A1 Jun. 2, 2022

Related U.S. Application Data

(60) Provisional application No. 63/119,763, filed on Dec. 1, 2020.

(51) Int. Cl.

| | |
|---|---|
| ***B41J 11/42*** | (2006.01) |
| ***B41J 11/00*** | (2006.01) |
| ***B41J 11/02*** | (2006.01) |

(52) U.S. Cl.

CPC ..... *B41J 11/42* (2013.01); *B41J 11/008* (2013.01); *B41J 11/0065* (2013.01); *B41J 11/0095* (2013.01); *B41J 11/02* (2013.01)

(58) Field of Classification Search

CPC ..... B41J 11/42; B41J 11/0065; B41J 11/008; B41J 11/0095; B41J 11/02

See application file for complete search history.

(56) References Cited

U.S. PATENT DOCUMENTS

| | | | |
|---|---|---|---|
| 10,081,209 B2 | 9/2018 | Barron et al. | |
| 10,101,701 B1 | 10/2018 | Soures | |

FOREIGN PATENT DOCUMENTS

| | | | | |
|---|---|---|---|---|
| JP | 2004195878 A | * | 7/2004 | ..... B41J 29/46 |
| JP | 2010179992 A | * | 8/2010 | ..... B65H 7/14 |

* cited by examiner

*Primary Examiner* — Yaovi M Ameh

(74) *Attorney, Agent, or Firm* — David A. Novais

(57) ABSTRACT

A printing system includes a media transport system configured to pick a sheet of media from a media supply and transport it along a media transport path to a printing module. An image capture system positioned along the media transport path, includes an image capture device positioned to capture a digital image of the sheet of media, and a platen positioned behind the sheet of media, wherein a surface of the platen includes a non-uniform density pattern, and wherein the captured digital image includes at least one edge of the sheet of media and a portion of the platen that extends beyond the edge of the sheet of media. An image analysis system automatically analyzes the captured digital image to detect an edge position of the sheet of media by detecting a platen region that includes the non-uniform density pattern and a media region.

11 Claims, 10 Drawing Sheets

PRINTING SYSTEM WITH UNIVERSAL MEDIA BORDER DETECTION

CROSS-REFERENCE TO RELATED APPLICATIONS

This application claims the benefit of U.S. Provisional Patent Application No. 63/119,763, filed Dec. 1, 2020, which is incorporated herein by reference in its entirety.

Reference is made to commonly assigned, U.S. Patent Application Ser. No. 17/523,007 (now US Publication No. 2022/0171320), entitled "Method for correcting media position errors in a printing system," by C.-H. Kuo, which is incorporated herein by reference.

FIELD OF THE INVENTION

This invention pertains to the field of digital printing, and more particularly to the detection and correction of media position errors in a digital printing system.

BACKGROUND OF THE INVENTION

Electrophotography is a useful process for printing images on a receiver (or "imaging substrate"), such as a piece or sheet of paper or another planar medium (e.g., glass, fabric, metal, or other objects) as will be described below. In this process, an electrostatic latent image is formed on a photoreceptor by uniformly charging the photoreceptor and then discharging selected areas of the uniform charge to yield an electrostatic charge pattern corresponding to the desired image (i.e., a "latent image").

After the latent image is formed, charged toner particles are brought into the vicinity of the photoreceptor and are attracted to the latent image to develop the latent image into a toner image. Note that the toner image may not be visible to the naked eye depending on the composition of the toner particles (e.g., clear toner).

After the latent image is developed into a toner image on the photoreceptor, a suitable receiver is brought into juxtaposition with the toner image. A suitable electric field is applied to transfer the toner particles of the toner image to the receiver to form the desired print image on the receiver. The imaging process is typically repeated many times with reusable photoreceptors.

The receiver is then removed from its operative association with the photoreceptor and subjected to heat or pressure to permanently fix (i.e., "fuse") the print image to the receiver. Plural print images (e.g., separation images of different colors) can be overlaid on the receiver before fusing to form a multi-color print image on the receiver.

As a sheet of media is picked from a media supply and transported along a media transport path in a printer, the position of the sheet of media can vary from its expected position. As a result, the position of the printed image content can be misregistered relative to its intended position on the sheet of media. In order to correct such registration errors, it is necessary to detect the actual position of the sheet of media. However, prior art methods for detecting the media position errors have been found to not be robust to different types of media. Notably, methods that work well for white media may not work well for dark colored media. There remains a need for an improved method to detect and correct for media position errors in a digital printing system.

SUMMARY OF THE INVENTION

The present invention represents a printing system for printing on sheets of media, including:

a printing module for printing image data on the sheets of media;

a media supply system including a media tray adapted to be loaded with a plurality of sheets of media;

a media transport system configured to pick a next sheet of media from the media tray and transport it along a media transport path through the printing system wherein image data is printed onto the sheet of media by the printing module;

an image capture system positioned along the media transport path, the image captures system including:

an image capture device positioned to capture a digital image of a first side of the sheet of media; and a platen positioned behind the sheet of media, wherein a surface of the platen that faces a second side of the sheet of media includes a non-uniform density pattern;

wherein the captured digital image includes at least one edge of the sheet of media and a portion of the platen that extends beyond the at least one edge of the sheet of media; and an image analysis system configured to automatically analyze the captured digital image to detect an edge position of the sheet of media by detecting a platen region in the captured image that includes the non-uniform density pattern of the platen and a media region corresponding to the sheet of media, wherein the edge of the sheet of media corresponds to the boundary between the platen region and the media region; and wherein a position that the printing module prints image data onto the sheet of media is adjusted responsive to a difference between the detected edge position and an expected edge position.

This invention has the advantage that the edge position of the sheet of media can be reliably determined for a wide variety of media types having different media colors.

It has the additional advantage that detected media position errors can be corrected by adjusting the position that image data is printed onto the sheet of media.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

Figure 1:
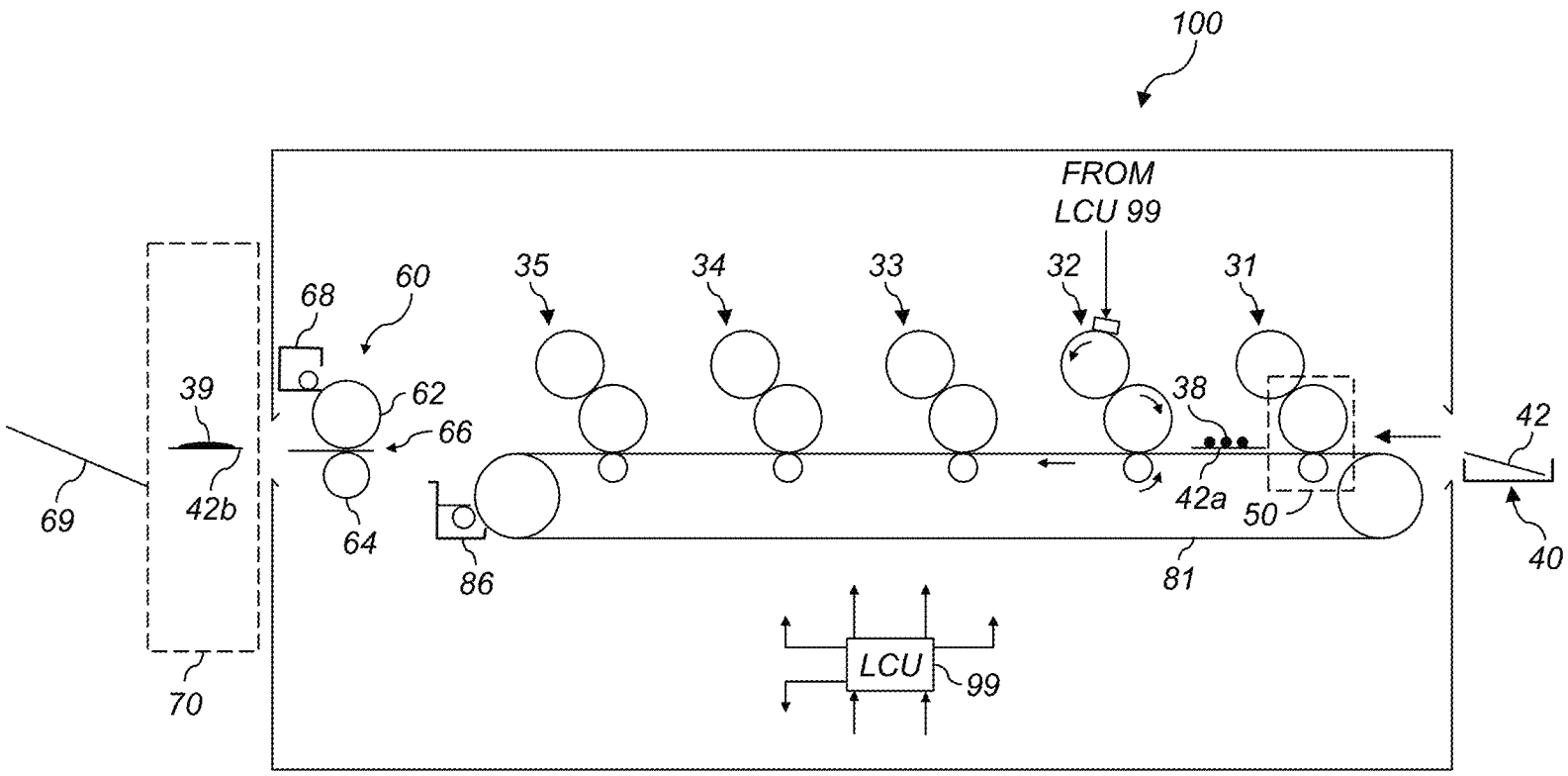
FIG. 1 (Prior Art)
FIG. 1 is an elevational cross-section of an electrophotographic printer suitable for use with various embodiments.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated, or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

As used herein, "toner particles" are particles of one or more material(s) that are transferred by an electrophotographic (EP) printer to a receiver to produce a desired effect or structure (e.g., a print image, texture, pattern, or coating) on the receiver. Toner particles can be ground from larger solids, or chemically prepared (e.g., precipitated from a solution of a pigment and a dispersant using an organic solvent), as is known in the art. Toner particles can have a range of diameters (e.g., less than 8 μm, on the order of 10-15 μm, up to approximately 30 μm, or larger), where "diameter" preferably refers to the volume-weighted median diameter, as determined by a device such as a Coulter Multisizer. When practicing this invention, it is preferable to use larger toner particles (i.e., those having diameters of at least 20 μm) in order to obtain the desirable toner stack heights that would enable macroscopic toner relief structures to be formed.

"Toner" refers to a material or mixture that contains toner particles, and that can be used to form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

As mentioned already, toner includes toner particles; it can also include other types of particles. The particles in toner can be of various types and have various properties. Such properties can include absorption of incident electromagnetic radiation (e.g., particles containing colorants such as dyes or pigments), absorption of moisture or gasses (e.g., desiccants or getters), suppression of bacterial growth (e.g., biocides, particularly useful in liquid-toner systems), adhesion to the receiver (e.g., binders), electrical conductivity or low magnetic reluctance (e.g., metal particles), electrical resistivity, texture, gloss, magnetic remanence, florescence, resistance to etchants, and other properties of additives known in the art.

In single-component or mono-component development systems, "developer" refers to toner alone. In these systems, none, some, or all of the particles in the toner can themselves be magnetic. However, developer in a mono-component system does not include magnetic carrier particles. In dual-component, two-component, or multi-component development systems, "developer" refers to a mixture including toner particles and magnetic carrier particles, which can be electrically-conductive or -non-conductive. Toner particles can be magnetic or non-magnetic. The carrier particles can be larger than the toner particles (e.g., 15-20 μm or 20-300 μm in diameter). A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields). The present invention can be practiced using any type of electrographic printing system, including electrophotographic and ionographic printers.

A digital reproduction printing system ("printer") typically includes a digital front-end processor (DFE), a print engine (also referred to in the art as a "printing module" or a "marking engine") for applying toner to the receiver, and one or more post-printing finishing system(s) (e.g., a UV coating system, a glosser system, or a laminator system). A printer can reproduce pleasing black-and-white or color images onto a receiver. A printer can also produce selected patterns of toner on a receiver, which patterns (e.g., surface textures) do not correspond directly to a visible image.

The DFE receives input electronic files (such as Postscript command files) composed of images from other input devices (e.g., a scanner, a digital camera or a computer-generated image processor). Within the context of the present invention, images can include photographic renditions of scenes, as well as other types of visual content such as text or graphical elements. Images can also include invisible content such as specifications of texture, gloss or protective coating patterns.

The DFE can include various function processors, such as a raster image processor (RIP), image positioning processor, image manipulation processor, color processor, or image storage processor. The DFE rasterizes input electronic files into image bitmaps for the printing module to print. In some embodiments, the DFE permits a human operator to set up parameters such as layout, font, color, paper type, or post-finishing options. The printing module takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system that accounts for characteristics of the image printing process implemented in the printing module (e.g., the electrophotographic process) to provide known, consistent color reproduction characteristics. The color management system can also provide known color reproduction for different inputs (e.g., digital camera images or film images). Color management systems are well-known in the art, and any such system can be used to provide color corrections in accordance with the present invention.

In an embodiment of an electrophotographic modular printing machine useful with various embodiments (e.g., the NEXPRESS SX 3900 printer manufactured by Eastman Kodak Company of Rochester, N.Y.) color-toner print images are made in a plurality of color imaging modules arranged in tandem, and the print images are successively electrostatically transferred to a receiver adhered to a transport web moving through the modules. Colored toners include colorants, (e.g., dyes or pigments) which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing features such as protecting the print from fingerprints, reducing certain visual artifacts or providing desired texture or surface finish characteristics. Clear toner uses particles that are similar to the toner particles of the color development stations but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
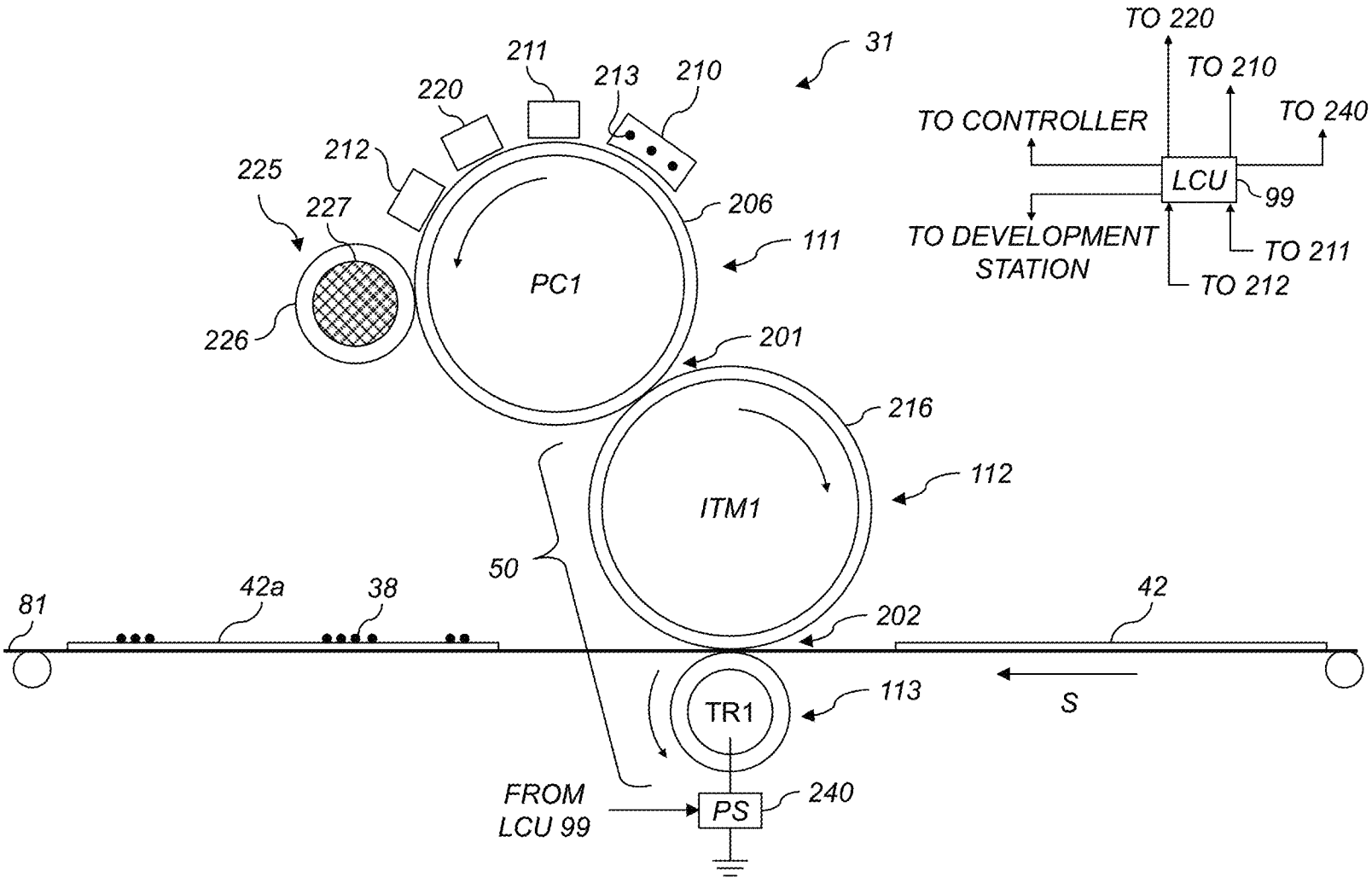
FIG. 2 (Prior Art)
FIG. 2 is an elevational cross-section of one printing module of the electrophotographic printer of FIG. 1.

FIGS. 1-2 are elevational cross-sections showing portions of a typical electrophotographic printer 100 useful with various embodiments. Printer 100 is adapted to produce images, such as single-color images (i.e., monochrome images), or multicolor images such as CMYK, or pentachrome (five-color) images, on a receiver. Multicolor images are also known as "multi-component" images. One embodiment involves printing using an electrophotographic print engine having five sets of single-color image-producing or image-printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module 31, 32, 33, 34, 35 produces a single-color toner image for transfer using a respective transfer subsystem 50 (for clarity, only one is labeled) to a receiver 42 successively moved through the modules. In some embodiments one or more of the printing module 31, 32, 33, 34, 35 can print a colorless toner image, which can be used to provide a protective overcoat or tactile image features. Receiver 42 is transported from supply unit 40, which can include active feeding subsystems as known in the art, into printer 100 using a transport web 81. In various embodiments, the visible image can be transferred directly from an imaging roller to a receiver, or from an imaging roller to one or more transfer roller(s) or belt(s) in sequence in transfer subsystem 50, and then to receiver 42. Receiver 42 is, for example, a selected section of a web or a cut sheet of a planar receiver media such as paper or transparency film.

In the illustrated embodiments, each receiver 42 can have up to five single-color toner images transferred in registration thereon during a single pass through the five printing modules 31, 32, 33, 34, 35 to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an exemplary embodiment, printing module 31 forms black (K) print images, printing module 32 forms yellow (Y) print images, printing module 33 forms magenta (M) print images, and printing module 34 forms cyan (C) print images.

Printing module 35 can form a red, blue, green, or other fifth print image, including an image formed from a clear toner (e.g., one lacking pigment). The four subtractive primary colors, cyan, magenta, yellow, and black, can be combined in various combinations of subsets thereof to form a representative spectrum of colors. The color gamut of a printer (i.e., the range of colors that can be produced by the printer) is dependent upon the materials used and the process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g., metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42*a* is shown after passing through printing module 31. Print image 38 on receiver 42*a* includes unfused toner particles. Subsequent to transfer of the respective print images, overlaid in registration, one from each of the respective printing modules 31, 32, 33, 34, 35, receiver 42*a* is advanced to a fuser module 60 (i.e., a fusing or fixing assembly) to fuse the print image 38 to the receiver 42*a*. Transport web 81 transports the print-image-carrying receivers to the fuser module 60, which fixes the toner particles to the respective receivers, generally by the application of heat and pressure. The receivers are serially de-tacked from the transport web 81 to permit them to feed cleanly into the fuser module 60. The transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along the transport web 81 before or after cleaning station 86 in the direction of rotation of transport web 81.

In the illustrated embodiment, the fuser module 60 includes a heated fusing roller 62 and an opposing pressure roller 64 that form a fusing nip 66 therebetween. In an embodiment, fuser module 60 also includes a release fluid application substation 68 that applies release fluid, e.g., silicone oil, to fusing roller 62. Alternatively, wax-containing toner can be used without applying release fluid to the fusing roller 62. Other embodiments of fusers, both contact and non-contact, can be employed. For example, solvent fixing uses solvents to soften the toner particles so they bond with the receiver. Photoflash fusing uses short bursts of high-frequency electromagnetic radiation (e.g., ultraviolet light) to melt the toner. Radiant fixing uses lower-frequency electromagnetic radiation (e.g., infrared light) to more slowly melt the toner. Microwave fixing uses electromagnetic radiation in the microwave range to heat the receivers (primarily), thereby causing the toner particles to melt by heat conduction, so that the toner is fixed to the receiver.

The fused receivers (e.g., receiver 42*b* carrying fused image 39) are transported in series from the fuser module 60 along a path either to an output tray 69, or back to printing modules 31, 32, 33, 34, 35 to form an image on the backside of the receiver (i.e., to form a duplex print). Receivers 42*b* can also be transported to any suitable output accessory. For example, an auxiliary fuser or glossing assembly can provide a clear-toner overcoat. Printer 100 can also include multiple fuser modules 60 to support applications such as overprinting, as known in the art.

In various embodiments, between the fuser module 60 and the output tray 69, receiver 42*b* passes through a finisher 70. Finisher 70 performs various paper-handling operations, such as folding, stapling, saddle-stitching, collating, and binding.

Printer 100 includes main printer apparatus logic and control unit (LCU) 99, which receives input signals from various sensors associated with printer 100 and sends control signals to various components of printer 100. LCU 99 can include a microprocessor incorporating suitable look-up tables and control software executable by the LCU 99. It can also include a field-programmable gate array (FPGA), programmable logic device (PLD), programmable logic controller (PLC) (with a program in, e.g., ladder logic), microcontroller, or other digital control system. LCU 99 can include memory for storing control software and data. In some embodiments, sensors associated with the fuser module 60 provide appropriate signals to the LCU 99. In response to the sensor signals, the LCU 99 issues command and control signals that adjust the heat or pressure within fusing nip 66 and other operating parameters of fuser module 60. This permits printer 100 to print on receivers of various thicknesses and surface finishes, such as glossy or matte.

Image data for printing by printer 100 can be processed by a raster image processor (RIP; not shown), which can include a color separation screen generator or generators. The output of the RIP can be stored in frame or line buffers for transmission of the color separation print data to each of a set of respective LED writers associated with the printing modules 31, 32, 33, 34, 35 (e.g., for black (K), yellow (Y), magenta (M), cyan (C), and red (R) color channels, respectively). The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes (e.g., color correction) in order to obtain the desired color print. Color image data is separated into the respective colors and converted by the RIP to halftone dot image data in the respective color (for example, using halftone matrices, which provide desired screen angles and screen rulings). The RIP can be a suitably-programmed computer or logic device and is adapted to employ stored or computed halftone matrices and templates for processing separated color image data into rendered image data in the form of halftone information suitable for printing. These halftone matrices can be stored in a screen pattern memory.

FIG. 2 shows additional details of printing module 31, which is representative of printing modules 32, 33, 34, and 35 (FIG. 1). Photoreceptor 206 of imaging member 111 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors 206 can also contain multiple layers.

Charging subsystem 210 applies a uniform electrostatic charge to photoreceptor 206 of imaging member 111. In an exemplary embodiment, charging subsystem 210 includes a wire grid 213 having a selected voltage. Additional necessary components provided for control can be assembled about the various process elements of the respective printing modules. Meter 211 measures the uniform electrostatic charge provided by charging subsystem 210.

An exposure subsystem 220 is provided for selectively modulating the uniform electrostatic charge on photoreceptor 206 in an image-wise fashion by exposing photoreceptor 206 to electromagnetic radiation to form a latent electrostatic image. The uniformly-charged photoreceptor 206 is typically exposed to actinic radiation provided by selectively activating particular light sources in an LED array or a laser device outputting light directed onto photoreceptor 206. In embodiments using laser devices, a rotating polygon (not shown) is sometimes used to scan one or more laser beam(s) across the photoreceptor in the fast-scan direction. One pixel site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each pixel site in the row during that line exposure time.

As used herein, an "engine pixel" is the smallest addressable unit on photoreceptor 206 which the exposure subsystem 220 (e.g., the laser or the LED) can expose with a selected exposure different from the exposure of another engine pixel. Engine pixels can overlap (e.g., to increase addressability in the slow-scan direction). Each engine pixel has a corresponding engine pixel location, and the exposure applied to the engine pixel location is described by an engine pixel level.

The exposure subsystem 220 can be a write-white or write-black system. In a write-white or "charged-area-development" system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or "discharged-area development" system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

In the illustrated embodiment, meter 212 is provided to measure the post-exposure surface potential within a patch area of a latent image formed from time to time in a non-image area on photoreceptor 206. Other meters and components can also be included (not shown).

A development station 225 includes toning shell 226, which can be rotating or stationary, for applying toner of a selected color to the latent image on photoreceptor 206 to produce a developed image on photoreceptor 206 corresponding to the color of toner deposited at this printing module 31. Development station 225 is electrically biased by a suitable respective voltage to develop the respective latent image, which voltage can be supplied by a power supply (not shown). Developer is provided to toning shell 226 by a supply system (not shown) such as a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In some embodiments, the development station 225 employs a two-component developer that includes toner particles and magnetic carrier particles. The exemplary development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Development station 225 can also employ a mono-component developer comprising toner, either magnetic or non-magnetic, without separate magnetic carrier particles.

Transfer subsystem 50 includes transfer backup member 113, and intermediate transfer member 112 for transferring the respective print image from photoreceptor 206 of imaging member 111 through a first transfer nip 201 to surface 216 of intermediate transfer member 112, and thence to a receiver 42 which receives respective toned print images 38 from each printing module in superposition to form a composite image thereon. The print image 38 is, for example, a separation of one color, such as cyan. Receiver 42 is transported by transport web 81. Transfer to a receiver is effected by an electrical field provided to transfer backup member 113 by power source 240, which is controlled by LCU 99. Receiver 42 can be any object or surface onto which toner can be transferred from imaging member 111 by application of the electric field. In this example, receiver 42 is shown prior to entry into a second transfer nip 202, and receiver 42*a* is shown subsequent to transfer of the print image 38 onto receiver 42*a*.

In the illustrated embodiment, the toner image is transferred from the photoreceptor 206 to the intermediate transfer member 112, and from there to the receiver 42. Registration of the separate toner images is achieved by registering the separate toner images on the receiver 42, as is done with the NEXPRESS SX 3900. In some embodiments, a single transfer member is used to sequentially transfer toner images from each color channel to the receiver 42. In other embodiments, the separate toner images can be transferred in register directly from the photoreceptor 206 in the respective printing module 31, 32, 33, 34, 25 to the receiver 42 without using a transfer member. Either transfer process is suitable when practicing this invention. An alternative method of transferring toner images involves transferring the separate toner images, in register, to a transfer member and then transferring the registered image to a receiver.

LCU 99 sends control signals to the charging subsystem 210, the exposure subsystem 220, and the respective development station 225 of each printing module 31, 32, 33, 34, 35 (FIG. 1), among other components. Each printing module can also have its own respective controller (not shown) coupled to LCU 99.

One problem that can occur when operating the printer 100 (FIG. 1) is that the position of the sheets of receiver 42 can be somewhat variable as the are transported along the media transport path past the printing modules 31, 32, 33, 34, 35. This can cause the alignment of the printed image content to be variable relative to the receiver 42. For example, the printed image content can be off center.

Figure 3:
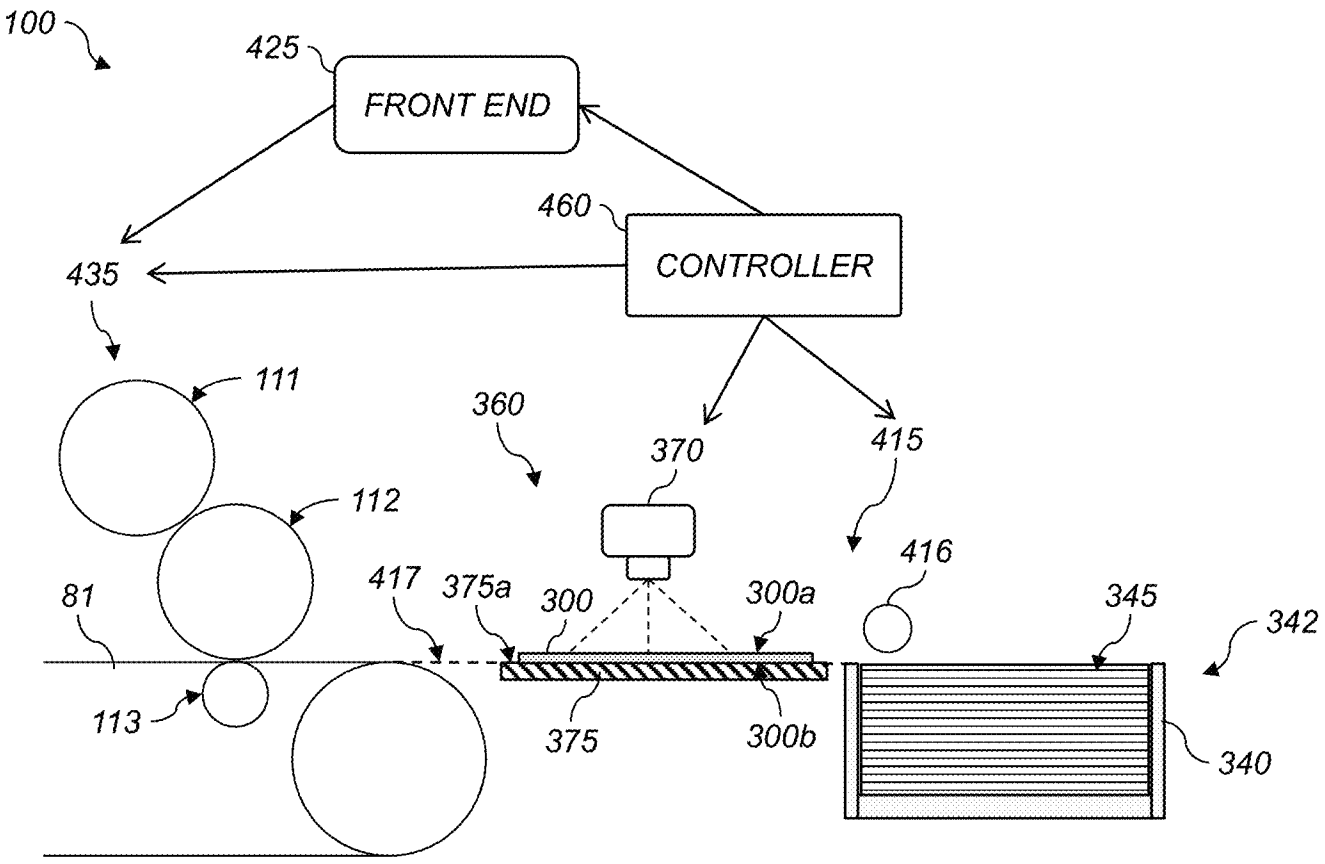
FIG. 3 shows a printer including a detection system for detecting media position in accordance with an exemplary embodiment.

FIG. 3 shows a portion of a printer 100 adapted to print on media sheets 300 supplied from a media tray 340 in a media supply system 342. The printer 100 includes an image capture system 360 that can be used to detect a media position of each media sheet 300. A media transport system 415 is used to transport media sheets 300 from a media stack 345 loaded into the media tray 340. The media transport system 415 can include various components such as rollers 416 and a transport web 81, as well as other components such as belts and media guides (not shown). The printer 100 includes at least one printing module 435 for printing on the media sheets 300. In an exemplary embodiment, the printing module 435 is similar to the printing module 31 of FIG. 2 and includes an imaging member 111, an intermediate transfer member 112 and a transfer backup member 113. The media sheet 300 is transported past the printing module 435 using a transport web 81. It will be obvious to one skilled in the art that the method of the present invention can alternatively be applied to printing systems including other types of printing modules 435, including other types of electrophotographic printing modules or other types of printing technology which are capable of variable data printing such as inkjet printers. A controller 460 is used to control various printer components including the media transport system 415, the image capture system 360, the printing module(s) 435, and a front end 425 that supplies image data to the printing module(s) 435.

The image capture system 360 includes an image capture device 370 and a platen 375 positioned behind the media sheet 300. The image capture device 370 can be any type of device for capturing digital images known in the art. In some embodiments, the image capture device 370 is a digital camera device which simultaneously captures a two-dimensional (2-D) image of at least a portion of the media sheet 300. In other embodiments, the image capture device 370 can be a digital scanner device such as a linear scanner that captures a 2-D digital image of at least a portion of a first side of the media sheet 300 (i.e., front side 300*a*) one one-dimensional (1-D) scan line at a time as the media sheet 300 is transported along the media transport path 417 past the linear scanner.

The image capture system 360 also includes a platen 375 positioned behind the media sheet 300 such that a second side of the media sheet 300 (i.e., back side 300*b*) faces, and typically is in contact with, a top surface 375*a* of the platen 375.

In accordance with the present invention, the image capture system 360 is positioned such that the captured digital image includes at least one edge of the media sheet 300 and a portion of the platen 375 that extends beyond the edge of the media sheet 300. A media position of the media sheet 300 can be determined by detecting the position of the edges of the media sheet 300 in the captured digital image.

Platens 375 used in conventional image capture systems 360 are generally solid neutral colors such as white or black or gray. However, this can be problematic for detecting the edges of the media sheet 300 in the captured digital image if the color of the media sheet 300 is too similar to the color of the top surface 375*a* of the platen 375. For example, if the media sheet 300 is white and the top surface 375*a* of the platen 375 is white there will be little or no detectable difference between the media sheet 300 and the platen 375 in the captured digital image. If it is known that the printer 100 will only be used to print on one type of media (e.g., white media sheets 300), then a platen can be used that has a top surface 375*a* having a contrasting color (e.g., black). However, many printers are adapted to print on a wide variety of media types that can include white media, gray media, black media and colored media. Therefore, a platen color that will provide a good contrast relative to one type of media may provide a poor contrast for another type of media. This can make the detection of the media position unreliable depending on the media type.

In accordance with exemplary embodiments of the present invention, the top surface 375*a* of the platen 375 includes a non-uniform density pattern. This makes it possible to reliably detect edges of the media sheets 300 in digital images captured by the image capture device 370 independent of the media type.

It should be noted that while FIG. 3 shows the image capture system 260 being positioned between the media supply 342 and the first printing module 435, one skilled in the art will recognize that it can alternatively be positioned at other locations within the printer 100. For example, it can be positioned after a last printing module 435 or between successive printing modules 435. An advantage to positioning the image capture system 260 before the first printing module 435 is that the determined media position error for a particular sheet of media 300 can be corrected for that sheet of media 300. If the image capture system 260 is positioned downstream of the printing module 435, the media position error can only be fed forward to correct future sheets of media. This only works if a majority of the media position errors are consistent from sheet-to-sheet.

Figure 4:
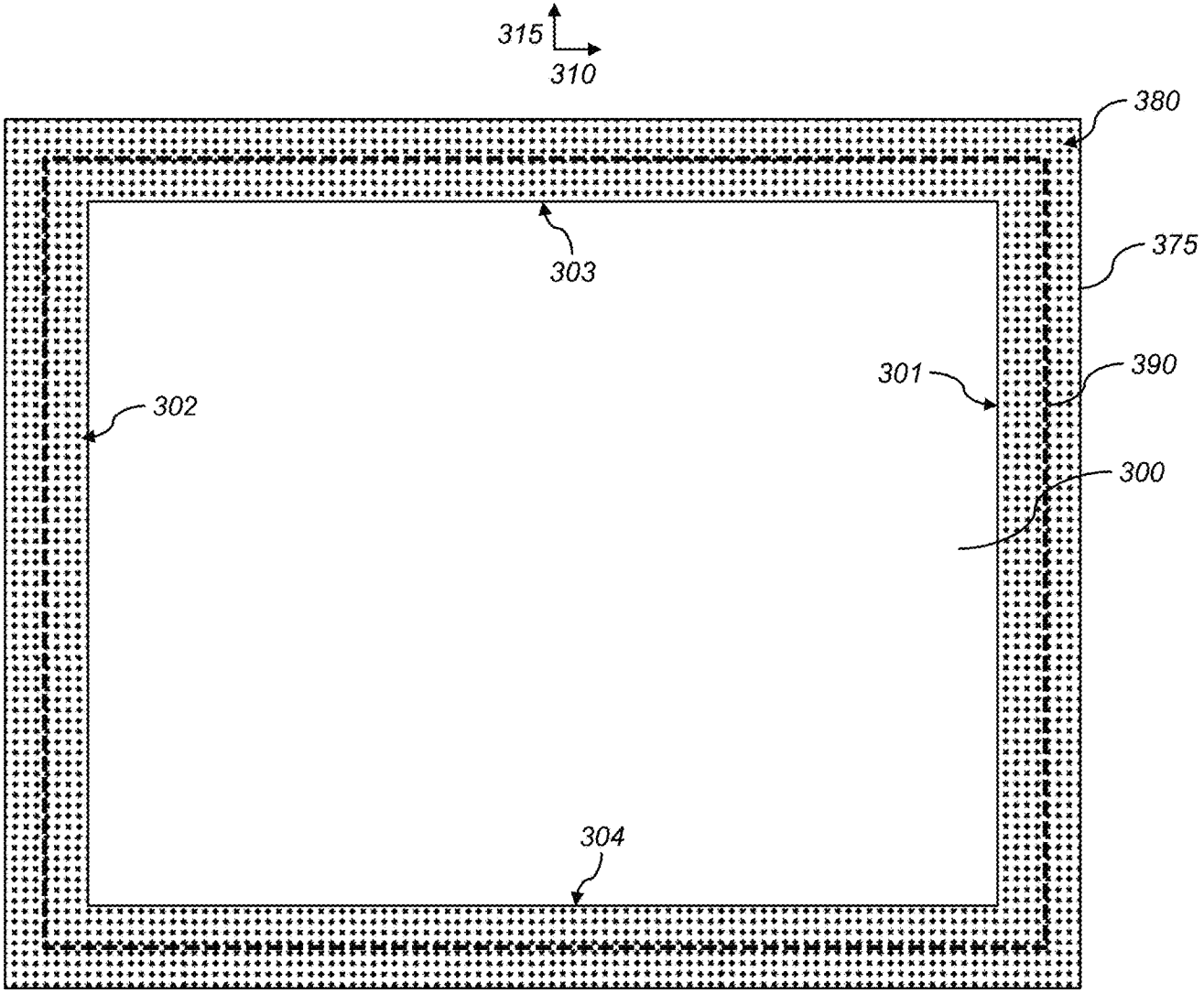
FIG. 4 illustrates an exemplary configuration showing a media sheet positioned over a platen having a non-uniform density pattern for use with a two-dimensional image capture device.

FIG. 4 illustrates an exemplary configuration showing a media sheet 300 positioned over a platen 375 having a non-uniform density pattern 380, which in this example is a periodic pattern of dots (e.g., a periodic halftone pattern). An imaging region 390 is shown corresponding to the region imaged by the image capture device 370 as the media sheet 300 is moved along the media transport path 417 (FIG. 3) in an in-track direction 315. In this example, the platen 375 extends beyond the edges of the media sheet in both the in-track direction 315 and the cross-track direction 310 and the imaging region 390 includes all four edges of the media sheet 300 (i.e., first side edge 301, second side edge 302, leading edge 303 and trailing edge 304). In this way, the location of the media sheet 300 can be determined by determining the positions of all four edges of the media sheet 300. In other embodiments, the imaging region 390 may only capture a subset of the edges of the media sheet 300 (e.g., only the first side edge 301). The determined location of the media sheet 300 can then be compared to an expected position to determine whether any corrections need to be applied to the image data in order to preserve the intended alignment between the image data and the media sheet 300.

Figure 5:
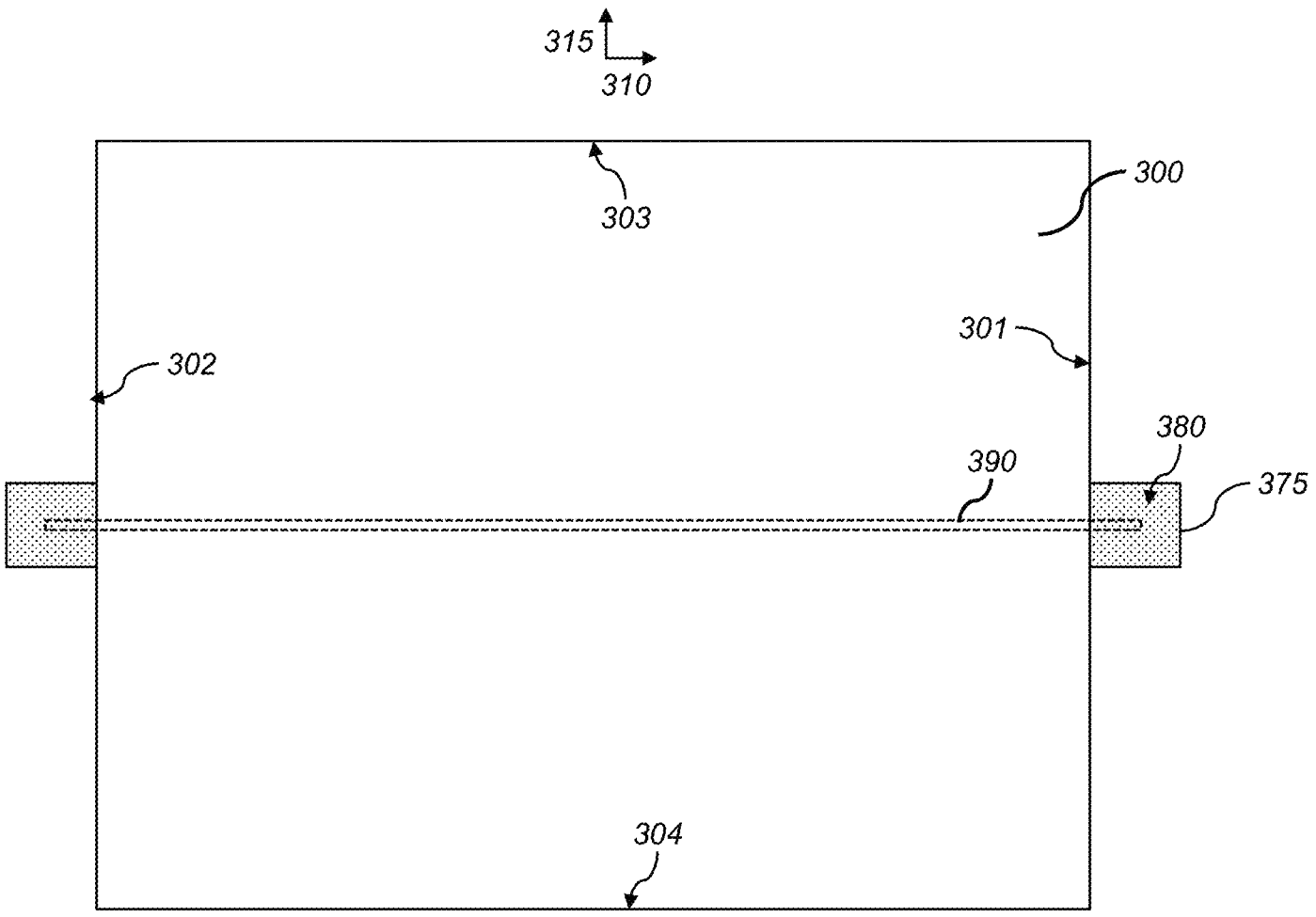
FIG. 5 illustrates an exemplary configuration showing a media sheet positioned over a platen having a non-uniform density pattern for use with a linear scanner device.

FIG. 5 illustrates an alternate embodiment where the image capture device 370 is a linear scanner device that captures a one-dimensional digital image in corresponding to a linear imaging region 390. A 2-D digital image of the media sheet 300 can be formed by capturing sequential 1-D images as the media sheet 300 moves past the linear scanner device. In this case, the platen 375 only needs to extend under the media sheet 300 in the vicinity of the linear imaging region 390.

Figure 6B:
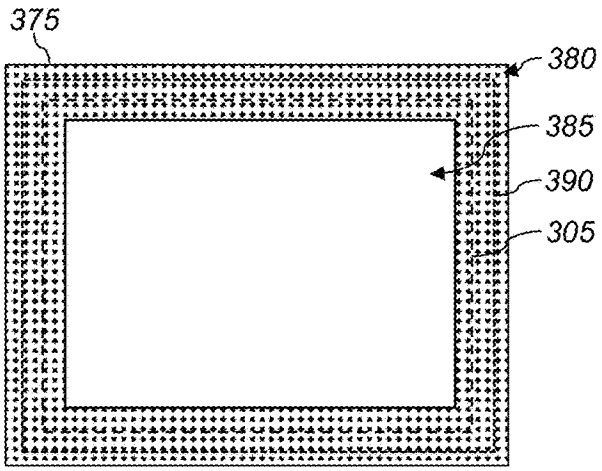
FIGS. 6A-6D illustrate exemplary platen configurations.
Figure 6D:
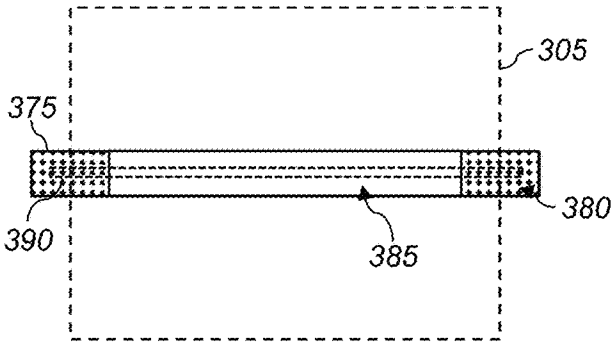
Figure 6A:
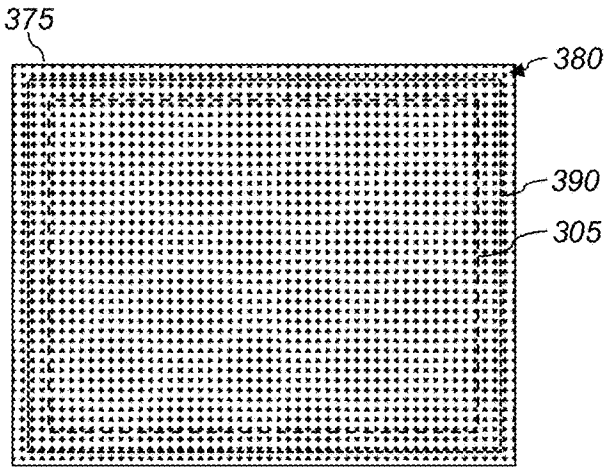

FIGS. 6A-6D illustrate a number of exemplary configurations for the platen 375. In FIG. 6A, the platen 375 extends beyond all four edges of the nominal media position 305, and the non-uniform density pattern 380 covers the entire surface of the platen 375, including the entire imaging region 390. This is similar to the configuration shown in FIG. 4.

The non-uniform density pattern 380 does not necessarily have to cover the entire top surface 375*a* of the platen 375, but it should at least cover a portion of the top surface 375*a* (FIG. 3) where at least one edge of the media sheet 300 is expected to be. FIG. 6B illustrates an embodiment where the non-uniform density pattern 380 only covers the portion of the platen 375 that is in the vicinity of the media edges of the nominal media position 305. In this example, the platen also includes a uniform density region 385 which is surrounded by the non-uniform density pattern 380.

Figure 6C:
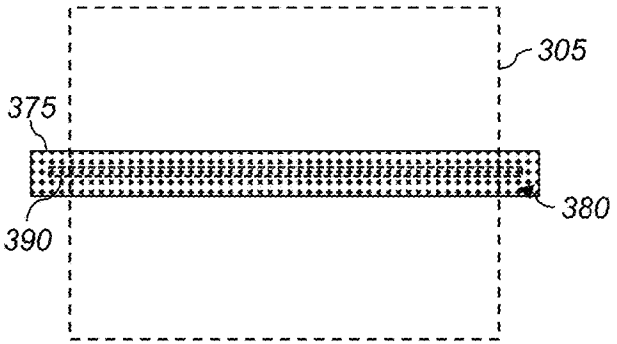

FIGS. 6C and 6D correspond to the case of the linear scanner device with a linear imaging region 390. In FIG. 6C, which is similar to the configuration of FIG. 5, the non-uniform density pattern 380 extends over the entire surface of the platen 375. In FIG. 6D, the non-uniform density pattern 380 only covers the portion of the platen 375 in the vicinity of the media edges of the nominal media position 305. A uniform density region 385 covers the central portion of the platen 375.

Figure 7:
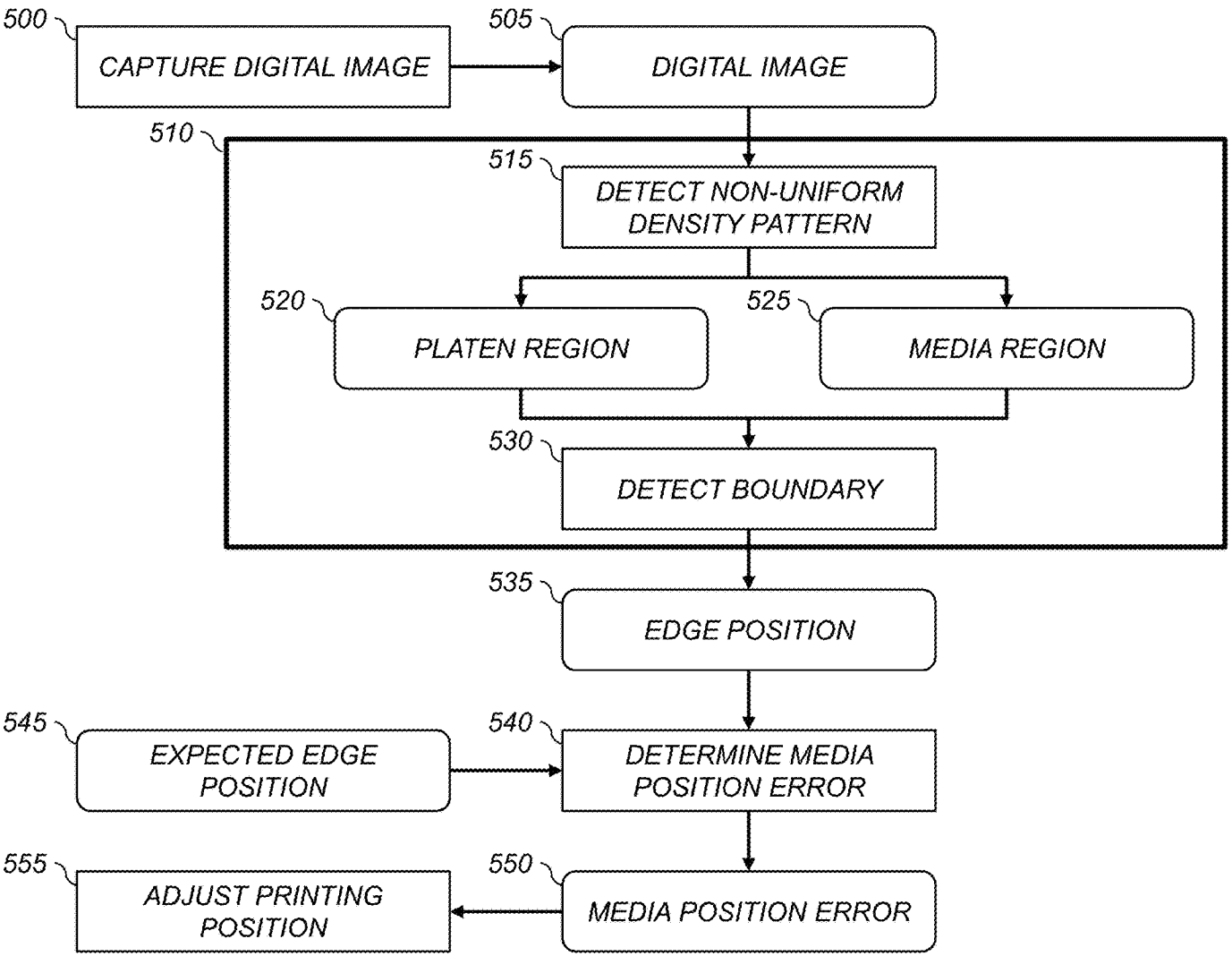
FIG. 7 illustrates a flow chart for a method of determining and correcting for media position errors.

FIG. 7 illustrates a method for making use of the image capture system 360 (FIG. 3) of the present invention to determine the media position error 550 for a media sheet 300 (FIG. 3) being transported along a media transport path 417 (FIG. 3) of a printer 100 (FIG. 3). A capture digital image step 500 is used to capture a digital image 505 of at least a portion of the front side 3001 (FIG. 3) of the media sheet 300 using the image capture system 360. The captured digital image 505 includes at least one edge of the media sheet 300, and a portion of the platen 375 (FIG. 3) that extends beyond the edge of the media sheet 300. The portion of the platen 375 includes a non-uniform density pattern 380 (FIG. 4).

An image analysis system (not shown) is then used to perform a detect edge position process 510 which analyzes the captured digital image 505 to determine an edge position 535 for one or more edges of the media sheet 300. The image analysis system can be any type of data processing system known in the art and will typically include one or more data processing devices that implement the detect edge position process 510. Examples of types of data processing devices that can be used to perform the detect edge position process 510 would include a central processing unit ("CPU"), a desktop computer, a laptop computer, a tablet computer, a mainframe computer, or any other device for processing data, managing data, or handling data, whether implemented with electrical, magnetic, optical, biological components, or otherwise. In exemplary embodiments, the data processing device can be the controller 460 (FIG. 3), or can be a separate component which is controlled by the controller 460.

In an exemplary embodiment, the detect edge position process 510 performs a detect non-uniform density pattern step 515 to detect the portions of the digital image 505 corresponding to the non-uniform density pattern 380 (FIG. 4) of the platen 375 (FIG. 4). The portion of the digital image 505 that contains the non-uniform density pattern 380 is designated to be a platen region 520, and the remaining portion (i.e., the portion corresponding to the media sheet 300) is designated to be a media region 525.

The detect non-uniform density pattern step 515 can use any appropriate image analysis method known in the art to detect the portions of the digital image 505 corresponding to the non-uniform density pattern 380. In an exemplary embodiment, the detect non-uniform density pattern step 515 uses a texture detection algorithm to differentiate between the media sheet 300 and the non-uniform density pattern 380. An exemplary type of texture detection algorithm that can be used in accordance with the present invention is a matched filter algorithm. Matched filter algorithms are well-known in the image processing art and are useful for detecting predefined patterns. Matched filter algorithms work by performing a cross-correlation of an unknown signal with a filter corresponding to a pattern to be detected, in this case the non-uniform density pattern 380. Other types of texture detection algorithms that can be used would include short-time Fourier transform algorithms and Wavelet transform algorithms. Those skilled in the image processing art would recognize how such algorithms could be applied to the detect non-uniform density pattern step 515 of the present invention.

In an exemplary embodiment, the detect non-uniform density pattern step 515 uses a variation of a matched filter algorithm in which the captured digital image 505 is compared to a reference digital image captured of the platen 375 without the media sheet present 300. In the platen region 520 of the digital image 505, there will be a close match between the captured digital image 505 and the reference digital image, whereas in the media region 525, the two images will be quite different.

A detection image d(x,y) can be computed which is a representation of the local similarity of the between the captured digital image 505 i(x,y) and the reference digital image, r(x,y). First, the pixel values in these images are shifted by subtracting a constant corresponding to the central code value and normalized so that they will have a range between −1 to 1:

$$\hat{i}(x, y)=(i(x, y)-i_c)/i_c \tag{1}$$

$$\hat{r}(x, y)=(r(x, y)-r_c)/r_c \tag{2}$$

where $\hat{i}(x, y)$ is the normalized captured digital image, $\hat{r}(x, y)$ is the normalized reference digital image, and $i_c$ and $r_c$ are the central code values of the captured digital image and the reference digital image, respectively. For example, the digital images will typically have code values ranging from 0 to 255. In this case, an appropriate central code values would be $i_c=r_c=128$.

The detection image d(x,y) can then be computed using the following equation:

$$d(x, y) = \left| \sum_{\Delta x=-N}^{N} \sum_{\Delta y=-N}^{N} \hat{i}(x+\Delta x, y+\Delta y)\hat{r}(x+\Delta x, y+\Delta y) \right| \tag{3}$$

where N is an integer which defines a local window size within which the "correlation" is computed. Preferably, N should be chosen such that the window includes at least one cycle of the non-uniform density pattern 380. In an exemplary configuration, the non-uniform density pattern 380 is a periodic dot pattern of about 200 dpi, and the image capture device 370 captures images at 600 dpi. Therefore a value of N=4 (corresponding to a 9×9 window) would include an array of 3×3 dots.

Within the platen region 520, $\hat{i}(x, y)\approx\hat{r}(x, y)$ so that whenever one is positive the other will be positive, and whenever one is negative the other will be negative. Therefore, when they are multiplied together, the result will always be positive and the detection signal will be high. On the other hand, within the media region 525, $\hat{i}(x, y)$ will approximately be positive while $\hat{r}(x, y)$ will vary between −1 and +1. As a result, the product will also vary between −1 and +1 and the detection signal will therefore be lower.

In other embodiments, the detection image d(x,y) can be determined by computing a standard deviation (or a variance) of the normalized captured digital image $\hat{i}(x, y)$ within a localized window around each x-y position. The standard deviation will be high in the platen region 520 due to the non-uniform density pattern 380 and will be low in the media region 525 since the media sheet 300 will be approximately uniform.

A thresholding operation using a predefined threshold $d_T$ can then be applied to determine a normalized detection image $\hat{d}(x, y)$ where the image pixels that correspond to the platen region 520 (d(x,y)>T) have a first value (e.g., 255), and the image pixels that correspond to the media region 525 (d(x,y)≤T) second value (e.g., 0):

$$\hat{d}(x, y) = \begin{cases} 255; & d(x, y) > T \\ 0; & d(x, y) \le T \end{cases} \tag{4}$$

The threshold T can be determined empirically by computing detection images for a plurality of different media types to find a threshold value that reliably segments the detection image into the platen region 520 and the media region 525.

A detect boundary step 530 can next be used to identify the boundary between the platen region 520 and the media region 525 in order to determine the edge position 535 for the media sheet 300. Edge detection algorithms are well-known in the image processing art and any such algorithm can be used to detect the edge position 535 in accordance with the present invention. In an exemplary configuration, a transition point between the platen region 520 and the media region 525 is determined for each line (or column) of the detection image. A linear function can then be fit to the x-y coordinates of transition points in order to determine the edge position as a function of position along the edge. This approach also provides a means to characterize any skew in the position of the media sheet 300 from the slope of the linear function will provide.

A determine media position error step 540 can then be used to determine a media position error 550 by comparing the edge position 535 to a predefined expected edge position 545 corresponding to a nominal position of the media sheet 300 if it were passing the image capture device 370 in perfect alignment. In a preferred embodiment, the edge position 535 is determined for all four edges of the media sheet 300. Furthermore, by determining the edge position 535 at different points along the edge in order to be able to characterize media skew.

In some embodiments, the determined media position error 550 is used to adjust a position that the printing module 435 (FIG. 3) prints image data onto the media sheet 300 (FIG. 3) as it passes through the printer 100 (FIG. 3). For example, if it is determined that the media sheet 300 is 1 mm to the right of the expected position, then the image data supplied by the front end 425 (FIG. 3) can likewise be shifted by 1 mm to the right so that the printed image data is properly aligned with its expected position on the media sheet 300.

Figure 8B:
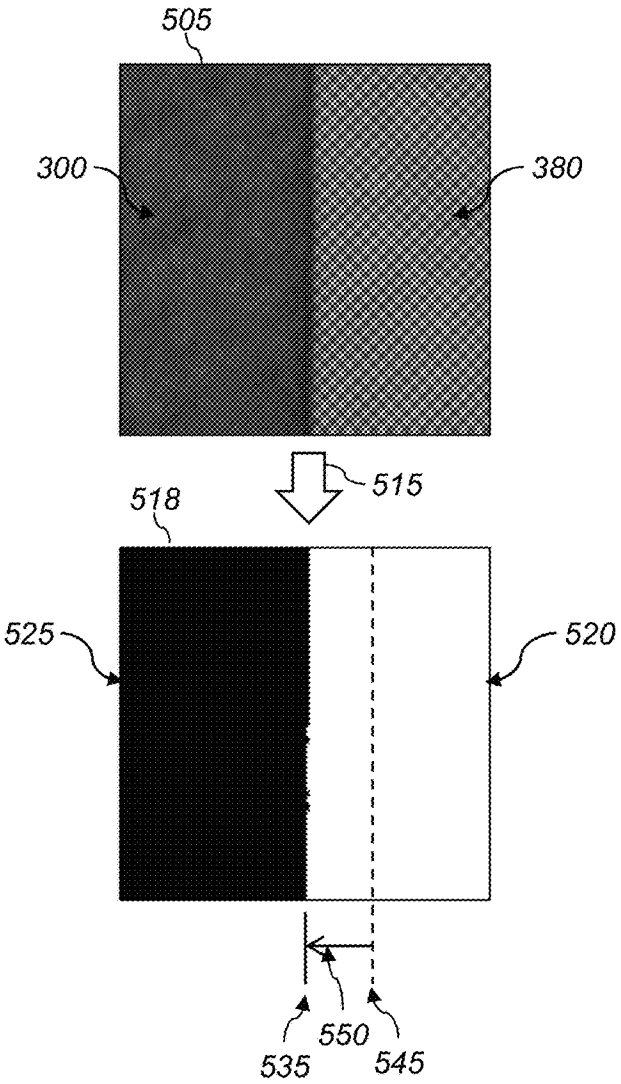
FIG. 8A-8B illustrate the determination of a platen region and a media region in a captured digital image.
Figure 8A:
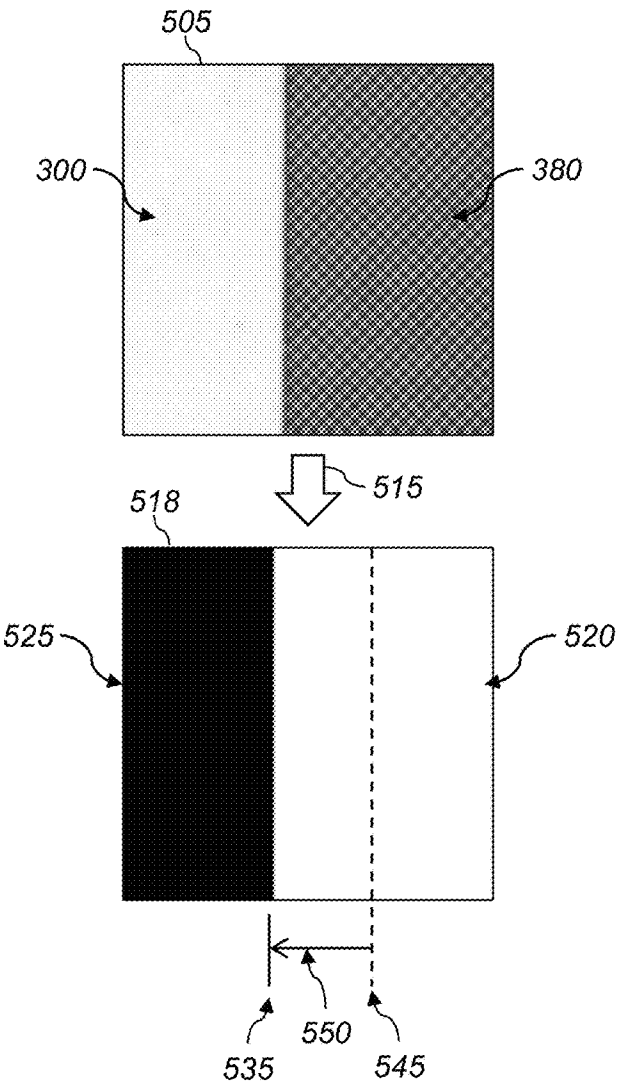

FIG. 8A shows a portion of an exemplary captured digital image 505 corresponding to a white media sheet 300 over a platen having a non-uniform density pattern 380 made up of a periodic dot pattern. The above-described detect non-uniform density pattern step 515 was used to compute a detection image 518, $\hat{d}(x, y)$. The white region of the detection image 518 corresponds to the platen region 520 and the black region of the detection image 518 corresponds to the media region 525.

The boundary between the platen region 520 and the media region 525 corresponds to the edge position 535 of the media sheet 300. The edge position 535 can be compared to the expected edge position to determine the media position error 550.

FIG. 8B is similar to FIG. 8A except that the media sheet 300 in the captured digital image 505 has a dark color instead of the white color in FIG. 8A. It can be seen that the detect non-uniform density pattern step 515 is able to successfully identify the platen region 520 and the media region 525 despite the different color of the media sheet 300.

Figure 9B:
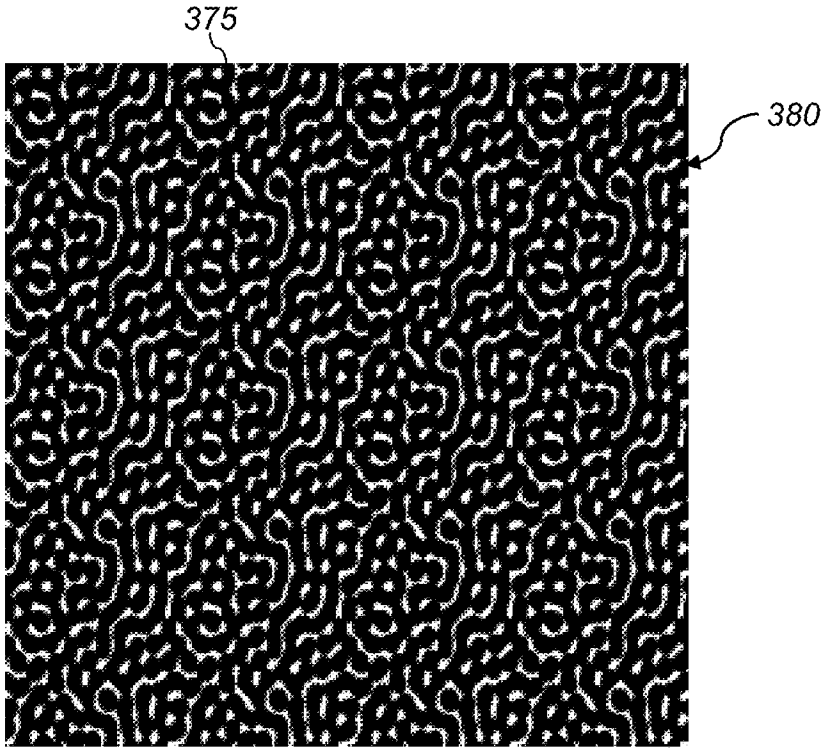
FIG. 9A-9B illustrate exemplary non-uniform density patterns.
Figure 9A:
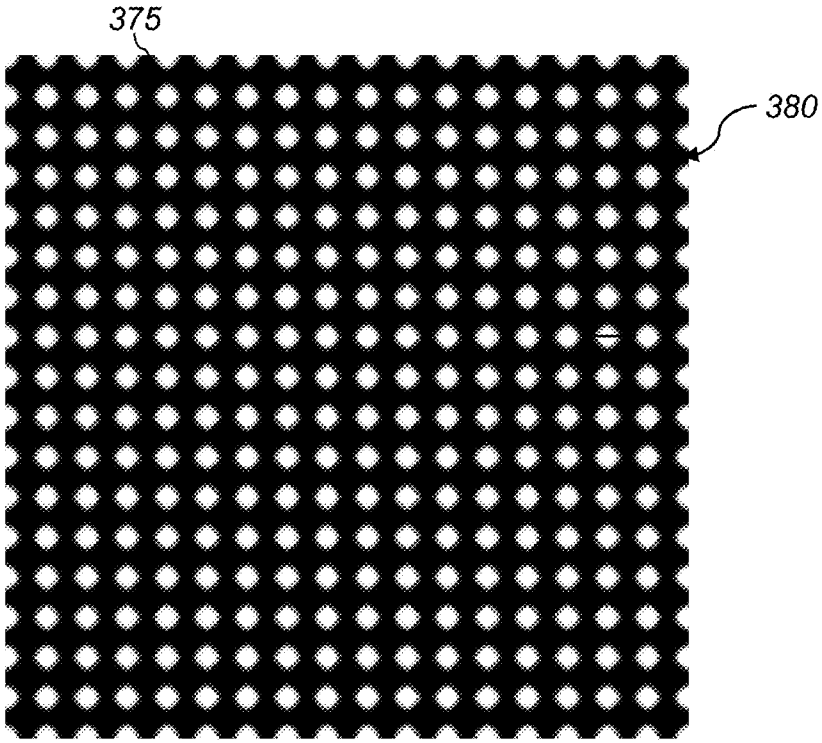

The exemplary embodiments that have been described have utilized a non-uniform density pattern 380 corresponding to a periodic dot pattern. FIG. 9A shows a close-up view of a segment of a platen 375 having one such exemplary non-uniform density pattern 380. In this case, the non-uniform density pattern 380 is a binary dot pattern corresponding to a conventional binary halftone pattern having about 70% coverage at a 0° screen angle. It will be obvious to one skilled in the art that many different types of non-uniform density patterns 380 can be used in accordance with the present invention. For example, binary halftone patterns having different dot coverages and/or different screen angles. In other configurations, the non-uniform density pattern 380 can be a non-binary pattern which varies continuously from a dark value to a light value. Furthermore, the non-uniform density pattern 380 can also be non-periodic in some embodiments. For example, FIG. 9B shows a platen 375 with a non-uniform density pattern 380 corresponding to a so-called "stochastic" texture pattern having a randomized appearance. Stochastic texture patterns are well-known in the art and can be created using a variety of means including stochastic halftoning algorithms such as error-diffusion or blue-noise dither. Such stochastic texture patterns preferably have "blue-noise" characteristics so that they little to no low-spatial frequency content.

Figure 10:
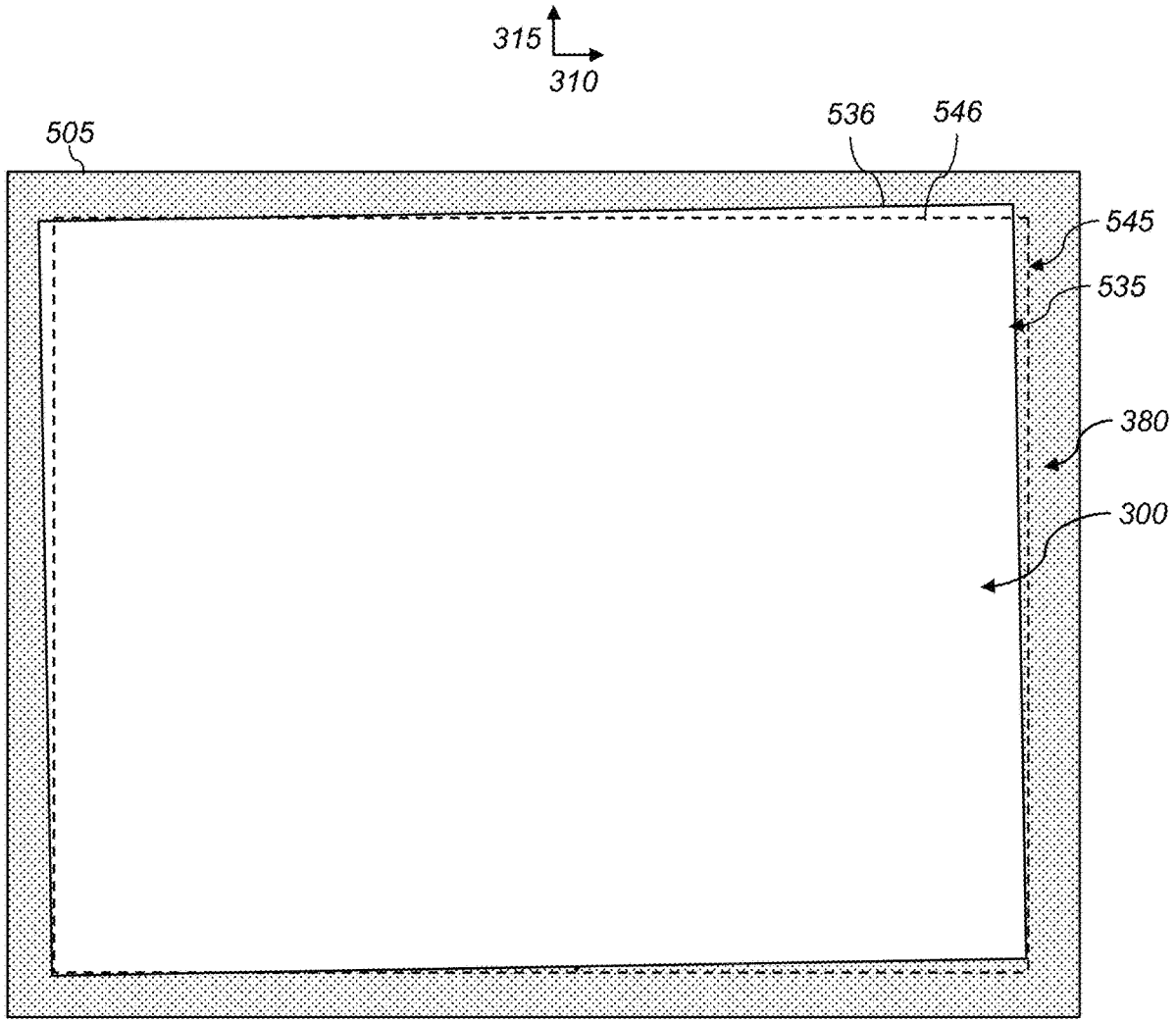
FIG. 10 illustrates the detection of a skewed media position.

In some embodiments, a cross-track media position error 550 (FIG. 7) in the cross-track direction 310 (FIG. 4) can be evaluated by determining edge positions 535 (FIG. 7) for the first side edge 301 (FIG. 4) or the second side edge 302 (FIG. 4) or both. Similarly, an in-track media position error 550 in the in-track direction 315 (FIG. 4) can be evaluated by determining edge positions 535 for the leading edge 303 (FIG. 4) or the trailing edge 304 (FIG. 4) or both. In some embodiments, a media skew can also be characterized by evaluating the edge position 534 and a corresponding media position error 550 along the length of one or more edges of the media sheet 330 in order to determine a skewed image boundary 536 as illustrated in FIG. 10. The skewed image boundary 536 can then be compared to an expected boundary 546 to determine a skew angle, as well as in-track and cross-track shifts. In some cases, the size of the media sheets 300 can be different than the expected media size (e.g., due to media expansion in a humid environment). the change in media size can be estimated from a difference in the media position errors 550 between the first side edge 301 or the second side edge 302, or between the leading edge 303 and the trailing edge 304.

The invention has been described in detail with particular reference to certain preferred embodiments thereof, but it will be understood that variations, combinations, and modifications can be effected by a person of ordinary skill in the art within the spirit and scope of the invention.

PARTS LIST

31 printing module
32 printing module
33 printing module
34 printing module
35 printing module
38 print image
39 fused image
40 supply unit
42 receiver
42*a* receiver
42*b* receiver
50 transfer subsystem
60 fuser module
62 fusing roller
64 pressure roller
66 fusing nip
68 release fluid application substation
69 output tray
70 finisher
81 transport web
86 cleaning station
99 logic and control unit
100 printer
111 imaging member
112 intermediate transfer member
113 transfer backup member

201 first transfer nip
202 second transfer nip
206 photoreceptor
210 charging subsystem
211 meter
212 meter
213 grid
216 surface
220 exposure subsystem
225 development subsystem
226 toning shell
227 magnetic core
240 power source
300 media sheet
300*a* front side
300*b* back side
301 first side edge
302 second side edge
303 leading edge
304 trailing edge
305 nominal media position
310 cross-track direction
315 in-track direction
340 media tray
342 media supply
345 media stack
360 image capture system
370 image capture device
375 platen
375*a* top surface
380 non-uniform density pattern
385 uniform density region
390 imaging region
415 media transport system
416 roller
417 media transport path
425 front end
435 printing module
460 controller
500 capture digital image step
505 digital image
510 detect edge position process
515 detect non-uniform density pattern step
518 detection image
520 platen region
525 media region
530 detect boundary step
535 edge position
536 skewed boundary
540 determine media position error step
545 expected edge position
546 expected boundary
550 media position error
555 adjust printing position step

The invention claimed is:

1. A printing system for printing on sheets of media, comprising:

a printing module for printing image data on the sheets of media;

a media supply system including a media tray adapted to be loaded with a plurality of sheets of media;

a media transport system configured to pick a next sheet of media from the media tray and transport it along a media transport path through the printing system wherein image data is printed onto the sheet of media by the printing module;

an image capture system positioned along the media transport path, the image captures system including:

an image capture device positioned to capture a digital image of a first side of the sheet of media; and a platen positioned behind the sheet of media, wherein a surface of the platen that faces a second side of the sheet of media includes a non-uniform density pattern;

wherein the captured digital image includes at least one edge of the sheet of media and a portion of the platen that extends beyond the at least one edge of the sheet of media; and an image analysis system configured to automatically analyze the captured digital image to detect an edge position of the sheet of media by detecting a platen region in the captured image that includes the non-uniform density pattern of the platen and a media region corresponding to the sheet of media, wherein the edge of the sheet of media corresponds to the boundary between the platen region and the media region; and wherein a position that the printing module prints image data onto the sheet of media is adjusted responsive to a difference between the detected edge position and an expected edge position.

2. The printing system of claim 1, wherein the image capture device is a digital camera device that captures a two-dimensional digital image.

3. The printing system of claim 1, wherein the image capture device is a linear scanner device that captures a one-dimensional digital image.

4. The printing system of claim 1, wherein the non-uniform density pattern on the surface of the platen is a periodic pattern.

5. The printing system of claim 1, wherein the non-uniform density pattern on the surface of the platen is a stochastic pattern.

6. The printing system of claim 1, wherein the image analysis system detects the platen region by computing a standard deviation or a variance of pixels in localized image window in the captured digital image.

7. The printing system of claim 1, wherein the image analysis system detects the platen region by using a matched filter to detect a portion of the captured image that includes the non-uniform density pattern.

8. The printing system of claim 1, wherein the detected edge position is for a side edge of the sheet of media, and wherein a cross-track position that the printing module prints image data onto the sheet of media is adjusted.

9. The printing system of claim 1, wherein the detected edge position is for a leading or trailing edge of the sheet of media, and wherein an in-track position that the printing module prints image data onto the sheet of media is adjusted.

10. The printing system of claim 1, wherein the image analysis system determines a media skew based on detected edge positions for a plurality of points around the boundary of the sheet of media, and wherein an image skew for the image data that the printing module prints onto the sheet of media is adjusted responsive to the determined media skew.

11. A printing system for printing on sheets of media, comprising:

a printing module for printing image data on the sheets of media;

a media supply system including a media tray adapted to be loaded with a plurality of sheets of media;

a media transport system configured to pick a next sheet of media from the media tray and transport it along a media transport path through the printing system wherein image data is printed onto the sheet of media by the printing module;

an image capture system positioned along the media transport path, the image captures system including:

an image capture device positioned to capture a digital image of a first side of the sheet of media; and a platen positioned behind the sheet of media, wherein a surface of the platen that faces a second side of the sheet of media includes a non-uniform density pattern;

wherein the captured digital image includes at least one edge of the sheet of media and a portion of the platen that extends beyond the at least one edge of the sheet of media; and an image analysis system configured to automatically analyze the captured digital image to detect an edge position of the sheet of media by detecting a platen region in the captured image that includes the non-uniform density pattern of the platen and a media region corresponding to the sheet of media, wherein the edge of the sheet of media corresponds to the boundary between the platen region and the media region;

wherein a position that the printing module prints image data onto the sheet of media is adjusted responsive to a difference between the detected edge position and an expected edge position; and wherein the image analysis system detects the platen region by comparing the captured digital image to a reference digital image of the platen with no overlaid sheet of media.

* * * * *